US006006826A

United States Patent [19]

Goddard et al.

[11] Patent Number: 6,006,826

[45] Date of Patent: Dec. 28, 1999

[54] ICE RINK INSTALLATION HAVING A POLYMER PLASTIC HEAT TRANSFER PIPING IMBEDDED IN A SUBSTRATE

[76] Inventors: Ralph Spencer Goddard; Bradley John Spencer Goddard, both of Box 4, Site 17, R.R. 1, Edmonton, Alberta, Canada, T6H 4N6; William Robert Ullrich, 1953 Hood River Rd., Mosier, Oreg. 97040

[21] Appl. No.: 09/057,132

[22] Filed: Apr. 8, 1998

Related U.S. Application Data

[63] Continuation-in-part of application No. 08/815,329, Mar. 10, 1997, abandoned.

[51] Int. Cl.[6] ..... F28F 1/42

[52] U.S. Cl. ..... 165/179; 165/45; 165/46; 165/184; 62/235

[58] Field of Search ..... 165/179, 46, 183, 165/184; 62/235

[56] References Cited

U.S. PATENT DOCUMENTS

| | | | |
|---|---|---|---|
| 349,060 | 9/1886 | Serve | 165/179 |
| 1,634,938 | 7/1927 | Funk | 62/235 |
| 1,810,926 | 6/1931 | Palson | 62/235 |
| 2,026,052 | 12/1935 | MacLeod | 62/235 |
| 2,769,315 | 11/1956 | Meadows | 62/235 |
| 3,599,441 | 8/1971 | Sills | 62/235 |
| 3,751,935 | 8/1973 | MacCracken et al. | 62/235 |
| 3,893,507 | 7/1975 | MacCracken et al. | 62/235 |
| 4,257,481 | 3/1981 | Dobson | 165/168 |
| 4,270,596 | 6/1981 | Zinn et al. | 165/46 |
| 4,394,817 | 7/1983 | Remillard | 165/46 |
| 4,549,606 | 10/1985 | Sato et al. | 165/179 |
| 4,660,630 | 4/1987 | Cunningham et al. | 165/179 |
| 4,703,597 | 11/1987 | Eggemar | 62/235 |
| 4,705,103 | 11/1987 | Zogg et al. | 165/179 |
| 4,735,261 | 4/1988 | Huebner | 165/76 |
| 4,749,031 | 6/1988 | Fukumoto | 165/159 |
| 4,779,673 | 10/1988 | Chiles et al. | 165/45 |
| 4,921,042 | 5/1990 | Zohler | 165/179 |
| 4,926,933 | 5/1990 | Gray | 165/173 |
| 4,979,373 | 12/1990 | Huppee | 62/235 |
| 5,052,476 | 10/1991 | Sukumoda et al. | 165/179 |
| 5,146,979 | 9/1992 | Zohler | 165/179 |
| 5,327,737 | 7/1994 | Eggemar | 165/46 |
| 5,331,826 | 7/1994 | Stockhaus et al. | 62/235 |
| 5,467,948 | 11/1995 | Gillespie | 248/68.1 |
| 5,832,995 | 11/1998 | Chiang et al. | 165/179 |

*Primary Examiner*—Ira S. Lazarus
*Assistant Examiner*—Terrell McKinnon
*Attorney, Agent, or Firm*—Davis and Bujold

[57] ABSTRACT

An ice rink installation having polymer plastic heat transfer piping imbedded in a substrate, such as concrete. The polymer plastic heat transfer piping extends throughout an ice rink and includes a tubular body having an exterior surface and an interior surface. The tubular body has a wall thickness of less than 8.5% of its inner diameter. In order for the tubular body to remain sufficiently robust with such thin walls, a plurality of vanes are positioned on either the exterior surface, the interior surface or on both surfaces.

18 Claims, 4 Drawing Sheets

ICE RINK INSTALLATION HAVING A POLYMER PLASTIC HEAT TRANSFER PIPING IMBEDDED IN A SUBSTRATE

This application is a continuation-in-part application of parent application Ser. No. 08/815,329 filed on Mar. 10, 1997 , now abandoned.

FIELD OF INVENTION

The present invention relates to polymer plastic heat transfer piping for ice rinks. More specifically, the invention relates to an ice rink installation having polymer plastic heat transfer piping imbedded in a substrate, such as concrete, with the polymer plastic heat transfer piping extending throughout the ice rink. The installation typically includes a heating source and a cooling source which are both coupled to a plurality of separate polymer plastic heat transfer piping segments such that when the heating source and the cooling source are utilized, the ice rink can be either heated or cooled as desired.

BACKGROUND OF THE INVENTION

An ice rink has a top surface, usually manufactured of concrete or sand, in which hundreds of feet of refrigerant piping or tubing is embedded. When the top surface of the ice rink is applied with water, either initially to form a layer of ice or to resurface the ice of the ice rink, a coolant from the cooling source is circulated through the refrigerant piping or tubing to effect a heat transfer to the water as the water lies on the exposed upper surface of the ice rink, thereby causing the applied water to form into ice.

For a number of years refrigerant piping or tubing has been made from a polymer plastic. When polymer plastic was first introduced, piping with an inner diameter of one inch (2.54 cm) had a wall thickness of approximately 0.125 inches (0.32 cm). In order to increase the efficiency of the heat transfer, experiments were attempted concerning a wall thickness of 0.085 inches (0.22 cm). It was found that this wall thickness was not sufficiently robust enough for refrigeration piping in ice rink applications. The piping or tubing tended to collapse when being covered with concrete and was easily punctured. As a result of such experiments, a minimum wall thickness of 0.100 inches (0.25 cm) was adopted as a standard for piping which had an inner diameter of one inch (2.54 cm). This standard remains recognized in the industry.

It is to be appreciated that if a robust refrigeration piping could be made with a thinner wall thickness, more efficient heat transfer would be obtained from the same.

SUMMARY OF THE INVENTION

What is required is a robust polymer plastic heat transfer piping with a wall thickness of less than 0.100 inches (0.25 cm).

According to the present invention, there is provided a polymer plastic heat transfer piping which includes a tubular body having an exterior surface and an interior surface. In order for the tubular body to have a thinner wall while still remaining sufficiently robust for a refrigeration piping application, a plurality of vanes are positioned on either the exterior surface, the interior surface or on both surfaces of the refrigeration piping. In a preferred form of the invention, the vanes are positioned on both the exterior surface and the interior surface.

The tubular polymer plastic body has a wall thickness which is between 5.0% and 8.5% of the inner diameter of the body of the tubular polymer plastic piping. Piping having a one inch (2.54 cm) inner diameter has a wall thickness of less than 0.085 inches (0.22 cm). Piping with a two inches (5.08 cm) diameter has a wall thickness of less than 0.165 inches (0.42 cm).

When polymer plastic refrigeration piping is set in concrete, some shrinkage generally occurs. This shrinkage tends to form air pockets or voids which serve as an insulator and, therefore, are detrimental to the efficient heat transfer from the piping to the ice rink.

A polymer plastic refrigeration piping with a thinner wall thickness and with vanes on either the interior or the exterior surface of the piping has a number of practical advantages. Firstly, the vanes reinforce the wall of the refrigeration piping and thereby render the wall more robust. Secondly, the thinner wall thickness promotes more effective heat transfer through the piping. Thirdly, the vanes provide a greater surface area over which a heat transfer can be effected. Fourthly, the exterior vanes assist with improving the contact between the refrigeration piping and the concrete, for example, while also facilitating secure anchoring the refrigeration piping within the concrete notwithstanding some shrinkage of the concrete.

In the prior art, the flow of a coolant or a heating fluid through a polymer plastic piping is a substantially laminar flow. This means that not all of the coolant or heating fluid comes in contact with the interior surface of the piping and, therefore, not all of the coolant or heating fluid may be fully utilized for heat transfer to the wall of the piping.

A polymer plastic refrigeration piping with a thinner wall thickness and vanes on at least the interior surface has a number of advantages. Firstly, the vanes reinforce the wall of the refrigeration piping and render the wall more robust. Secondly, the thinner wall thickness promotes more effective heat transfer through the wall. Thirdly, the vanes provide a greater surface area over which a heat transfer can be effected. Fourthly, the vanes provided on the interior surface of the wall can be used as a means for promoting a non-laminar flow through the refrigeration piping to facilitate a more efficient heat transfer of the coolant or the heating fluid to the wall of the piping. In a preferred form of the invention, at least the interior vanes are arranged in a helical pattern to promote non-laminar flow through the piping during use.

BRIEF DESCRIPTION OF THE DRAWINGS

The above and other features of the invention will become more apparent from the following description in which reference is made to the appended drawings, wherein.

DETAILED DESCRIPTION OF THE PREFERRED EMBODIMENT

Figure 3:
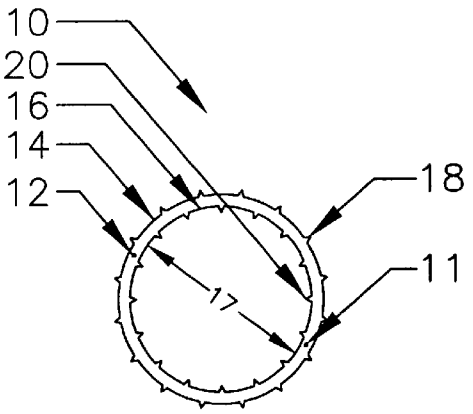
FIG. 3 is an end view of a third embodiment of the polymer plastic heat transfer piping, constructed in accordance with the teaching of the present invention, with vanes provided on both the interior surface and the exterior surface of the piping.

The preferred embodiment of a polymer plastic heat transfer piping, generally identified by reference numeral 10, will now be described with reference to FIGS. 1–4.

Figure 1:
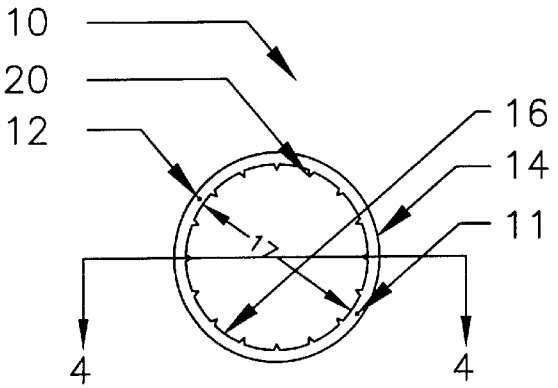
FIG. 1 is an end view of a first embodiment of the polymer plastic heat transfer piping, constructed in accordance with the teaching of the present invention, with vanes provided on the interior surface of the piping.

Referring first to FIG. 1, the polymer plastic heat transfer piping 10 includes a tubular body 12 having a wall 11 with an exterior surface 14 and an interior surface 16, and the body 12 defines an inner diameter 17. The wall thickness for polymer plastic heat transfer piping 10 is dependent upon the inner diameter 17 of the tubular body 12. It is preferred that the wall thickness be less than 8.5% of the dimension of the inner diameter 17. This relationship results in a wall thickness of less than 0.085 inches (0.22 cm) when the dimension of the inner diameter 17 of the tubular body 12 is one inch (2.54 cm). This wall thickness was previously found to be inadequate with known polymer plastic heat transfer piping.

The beneficial results have been obtained using a wall thickness of less than 0.065 inches (0.17 cm), or 6.5% of inner diameter 17 of the tubular body 12. It is believed that the wall thickness can be made as thin as 0.050 inches (0.13 cm), or 5% of the inner diameter 17 of the tubular body 12. A wall thickness of less than 0.050 inches (0.13 cm), however, is not recommended. The preferred wall thickness range is between about 8.5% and about 5% of the inner diameter 17 of the tubular body 12.

Figure 2:
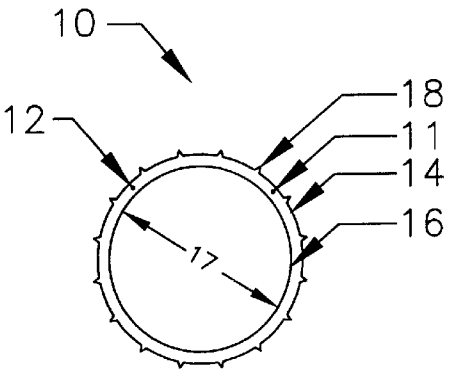
FIG. 2 is an end view of a second embodiment of the polymer plastic heat transfer piping, constructed in accordance with the teaching of the present invention, with vanes provided on the exterior surface of the piping.

In accordance with the present invention, a plurality of continuous vanes 20 are positioned on either the interior surface 16, as illustrated in FIG. 1, or a plurality of continuous vanes 18 are positioned on the exterior surface 14, as illustrated in FIG. 2. It is to be appreciated that a plurality of continuous vanes 18 and 20 can also be positioned on both the interior surface 16 and the exterior surface 14 of the body 12, as can be seen in FIG. 3.

Figure 4:
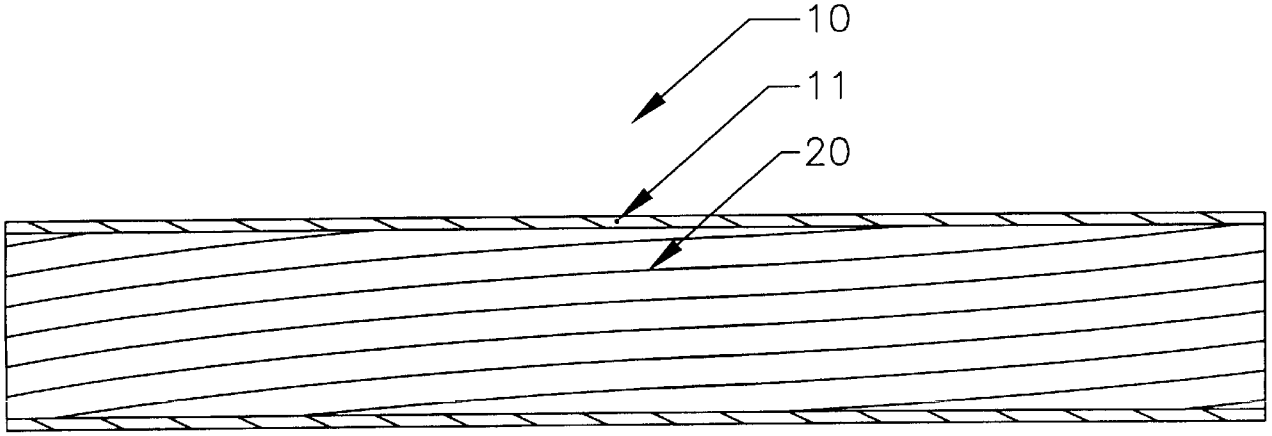
FIG. 4 is a diagrammatic cross-sectional view, along section line 4—4 of FIG. 1, of the polymer plastic heat transfer piping.

Referring now to FIG. 4, at least the vanes 20 are preferably arranged in a helical pattern for the purpose of promoting a non-laminar flow of the coolant or the heating fluid as it flows within the polymer plastic heat transfer piping 10. Preferred, both vanes 18, 20 are arranged in a helical pattern. The illustrated configuration of FIG. 3 has 16 separate continuous vanes 18 and 16 separate continuous vanes 20. It takes 36 inches (91.44 cm) of pipe length for the helical pattern of vanes 20 to rotate about 360 degrees, i.e. to rotate around the piping once completely.

Figure 6:
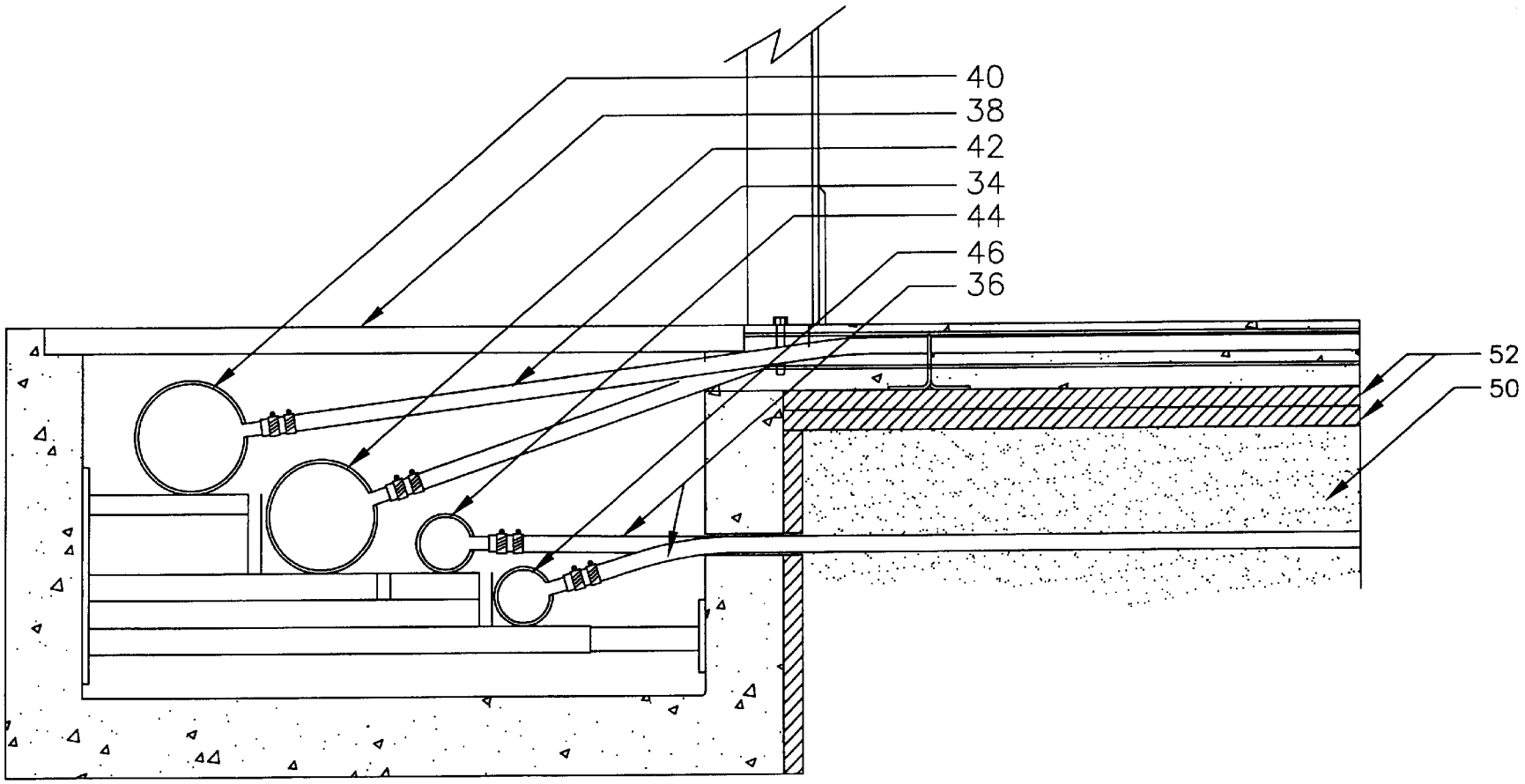
FIG. 6 is a diagrammatic cross-sectional view of a header trench, along section line 6—6 of FIG. 5, of an ice rink installation, according to the present invention, having the polymer plastic heat transfer piping.
Figure 7:
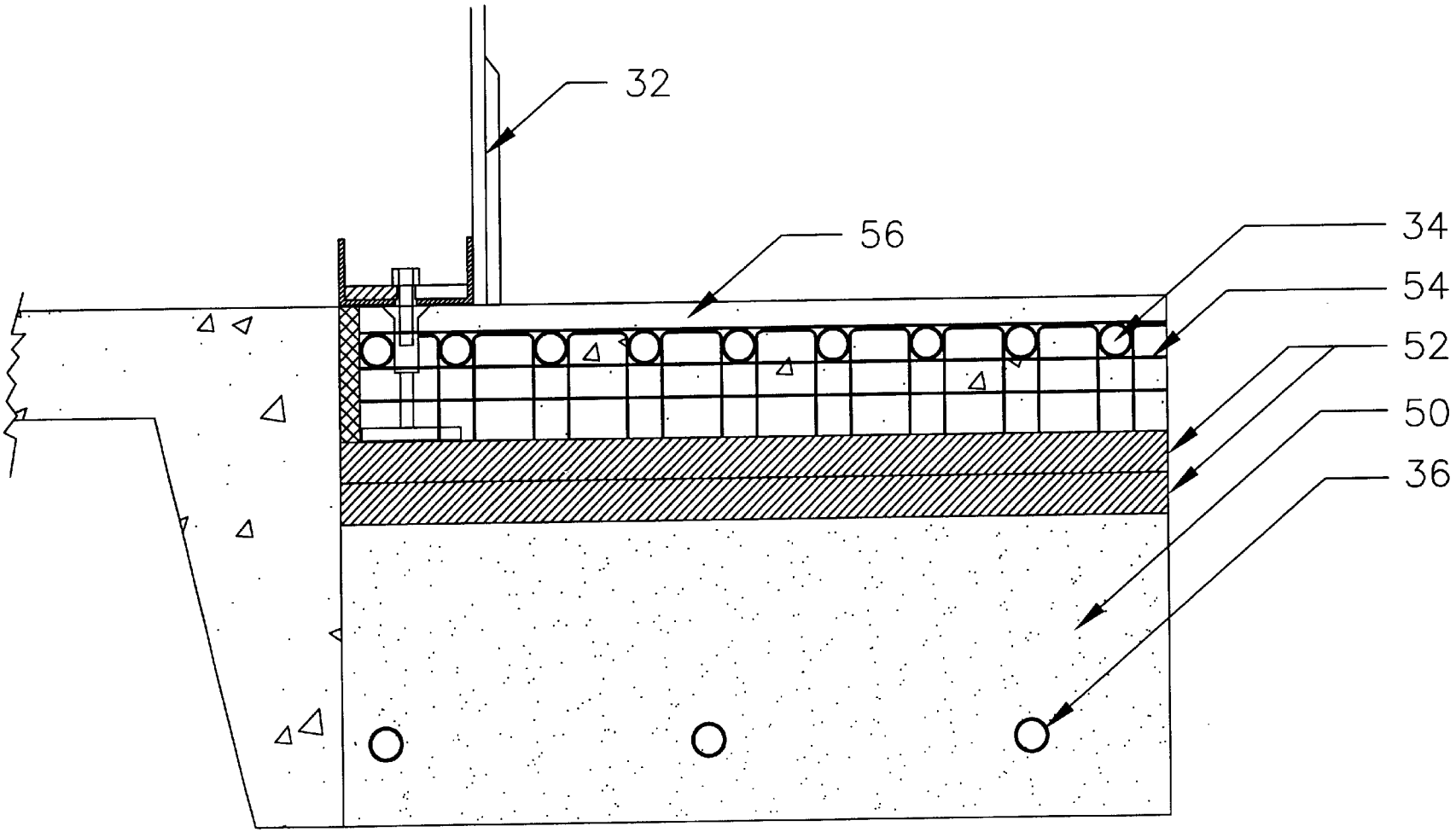
FIG. 7 is a diagrammatic cross-sectional view of a portion of the ice rink installation having the polymer plastic heat transfer piping as illustrated in FIG. 5.

The use and operation of the polymer plastic heat transfer piping 10, according to the present invention, will now be described with reference to FIGS. 5–7. As noted above, the tubular body 12 is typically set in a thin layer of concrete. As the concrete sets, some shrinkage generally occurs in the concrete and such shrinkage tends to form air pockets or voids. The exterior vanes 18 are provided to improve the contact between tubular body 12 and the concrete and securely anchor the heat transfer piping 10 within the concrete notwithstanding the formation of such air pockets or voids. The vanes 18, 20 also reinforce the wall 11 of the heat transfer piping 10 and thereby render the wall 11 more robust. The thinner wall thickness of the wall 11, in turn, promotes more effective heat transfer to the concrete, and the vanes 18 and 20 provide a greater surface area over which such heat transfer can occur. Further, the helical arrangement of at least the vanes 20 on the interior surface (FIG. 4) promotes a non-laminar flow of the coolant or the heating fluid as it flows through the heat transfer piping 10. The non-laminar flow allows the coolant or the heating fluid to be more efficiently used for heat transfer to the wall of the piping.

Figure 5:
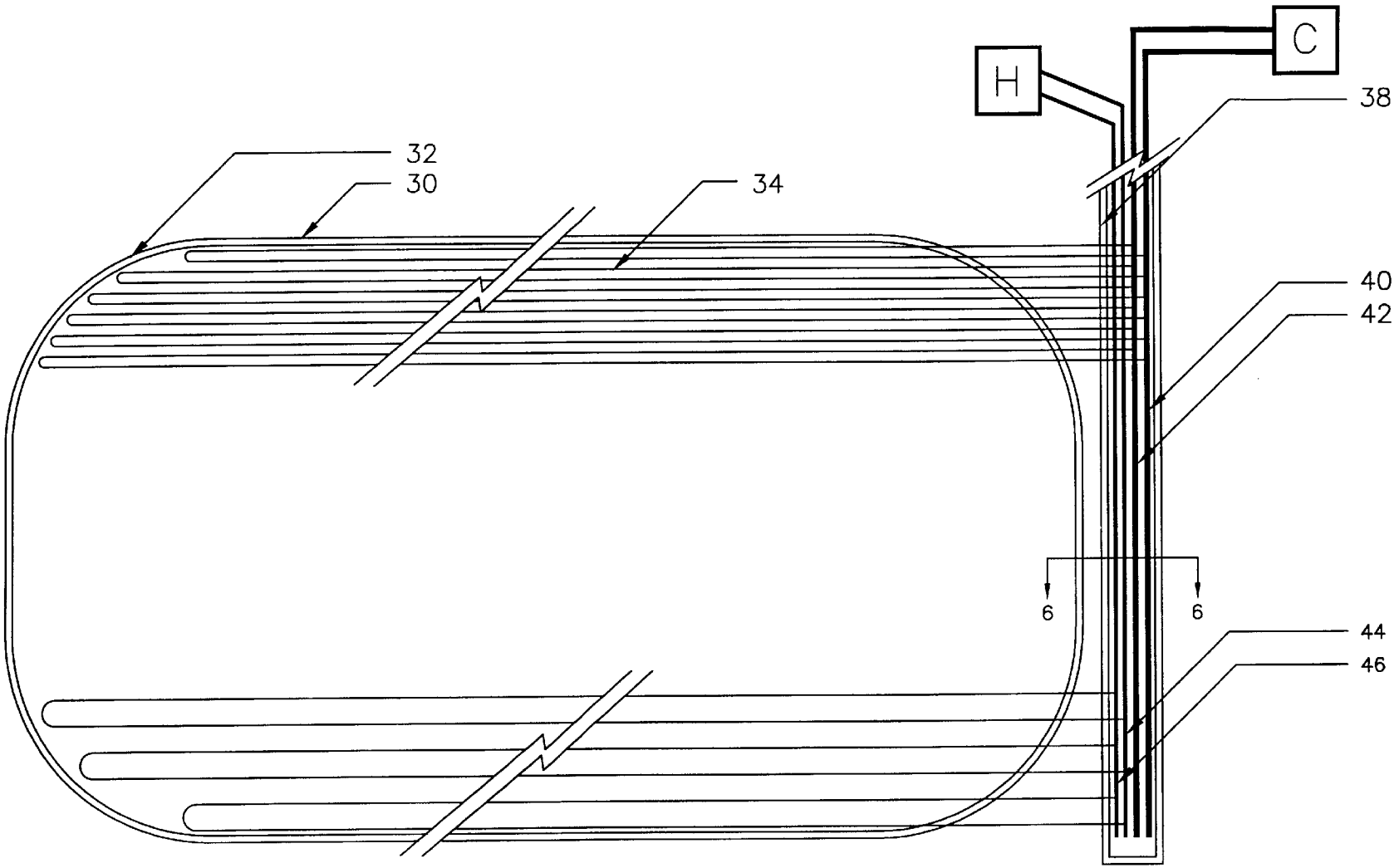
FIG. 5 is a diagrammatic top plan view of a polymer plastic heat transfer piping to be imbedded in a substrate for forming an ice rink installation in accordance with the teaching of the present invention.

In FIG. 5, the polymer plastic heat transfer piping is illustrated prior to being covered and imbedded in the concrete and/or sand, for forming an ice rink installation 30 according to the teaching of the present invention. The piping system of FIG. 5 consists of an upper first network of separate cooling pipes 34 (only shown in the top portion of FIG. 5), a lower second network of separate heating pipes 36 (only partially shown in the bottom portion of FIG. 5), and a header trench 38 (FIG. 6) for facilitating connection between a coolant source C and the cooling pipes 34 and for facilitating connection between a heat source H and the heating pipes 36. During formation of an ice rink installation, the area where the ice rink is to be installed is first suitably excavated. Thereafter, typically a layer of compact sand is first lined along the bottom of the excavated area. A plurality of lengths of the heating pipes 36 is arranged throughout the area, in a space relationship with respect to one another, and then the heating pipes 36 are covered with a further layer of sand (FIG. 7). Next, at least one, preferably two or more layers, of polystyrene insulation 52 are provided on top of the compacted sand layer 50. Then, a wire reinforcement 54 is provided throughout the area and the cooling pipes 34 are supported on the wire mesh reinforcements. Finally, the wire mesh reinforcement 54 and cooling pipes are covered with a layer of concrete 56. Each one of the cooling pipes 34 and heating pipes 36 communicate with a header trench 38, located along one end of the ice rink installation, and a further detailed description concerning the same will be provided below.

The boundaries of the ice rink 30 generally are delineated by a plurality of interconnected rink boards 32 to define a skating area. The ice rink 30 conventionally has first and second networks of cooling pipes and heating pipes 34 and 36 which all communicate with the header trench 38 located outside of the skating area defined by the rink boards 32. The header trench 38 has a cooling supply header pipe 40, connected to a supply outlet of the cooling source C, and a cooling return header pipe 42, connected to a return inlet of the cooling source C. A first end of each one of the separate cooling pipes 34 is connected to the cooling supply header pipe 40, in a conventional manner, and a second opposed end of each one of the cooling pipes 34 is connected to the cooling return header pipe 42, in a conventional manner.

In addition, a first end of each one of the separate heating pipes 36 is connected to the heating supply header pipe 44, in a conventional manner, and a second opposed end of each one of the heating pipes 36 is connected to the heating return header pipe 46, in a conventional manner. The cooling and heating pipes 34, 36, are appropriately distributed throughout the ice rink 30 to facilitate heating and/or cooling of the entire area of the ice rink 30.

As the coolant flows, within the coolant network, from the coolant source C through the cooling supply header pipe 40, the coolant is distributed to each one of the cooling pipes 34 embedded in the ice rink 30. The coolant flows along each one of the cooling pipes 34 and removes heat therefrom to provide a "cooling effect" to the cooling pipes 34 and, in turn, the concrete 56 located adjacent the exterior surface of the cooling pipes 34. The coolant, after flowing completely through the length of the cooling pipe 34, is then discharged into the cooling return header pipe 42 for returning the coolant back to the coolant source C.

As heating fluid flows, within the heating network, from the heating source H through the heating supply header pipe 44, the heating fluid is distributed to each one of the separate heating pipes 36 embedded below the surface of the ice rink 30. The heating fluid flows along each one of the heating pipes 36 and supplies heat thereto to provide a "heating effect" along the length of the heating pipes 36 and, in turn, to the sand bed 50, located adjacent the exterior surface of the heating piping 36. The heating fluid is then discharged into the heating return header pipe 46 for returning the heating fluid back to the heating source H. According to the present invention, all of the heating pipes 36 and the cooling pipes 34 are constructed of a polymer plastic heat transfer piping 10 as illustrated in FIGS. 1 to 4.

The vanes 18 on the exterior surface of the piping 10 serve to improve the contact between the piping 10 and concrete 56, notwithstanding shrinkage of concrete 56 that inevitably occurs. The vanes 20 provided on the interior surface of the piping 10 promote a non-laminar flow of fluid through the piping 10, and this non-laminar flow maximizes heat transfer to the coolant or from the heating fluid flowing through the piping 10. As a result of such non-laminar flow, a greater percentage of the coolant or the heating fluid is brought into intimate contact with the interior surface of the piping 10 to effect a desired heat transfer.

The vanes 18 and 20 on the interior and exterior surfaces of the body 12 of the piping 10 provide added rigidity to the piping 10, thereby allowing the piping 10 to be of a thinner wall thickness than that used in the past, and the thinner piping provides less resistance to heat transfer. The improved heat transfer of the piping 10 results in an increase in the overall efficiency of the cooling and/or the heating system and significant energy savings. Furthermore, the thinner wall thickness of the piping 10 provides more effective heat transfer therethrough. Also, the radial height of the vanes 18 and 20 on the exterior and interior surfaces of the piping 10 have a height less than the radial wall thickness of the body 12 to provide additional strength to the wall. In addition, the exterior vanes 18 facilitate secure attachment within the concrete or compacted sand.

It will be apparent to one skilled in the art that modifications may be made to the illustrated embodiment without departing from the spirit and scope of the invention as hereinafter defined in the claims.

We claim:

1. An ice rink installation having a plurality of interconnected rink boards defining a skating area of the ice rink installation, a polymer plastic piping being imbedded within a substrate of the ice rink installation at least beneath the skating area, said polymer plastic piping being coupled to a cooling source to provide a coolant to said polymer plastic piping and, in turn, said substrate to facilitate cooling of the ice rink installation, wherein said polymer plastic piping comprises:

a tubular polymer plastic body which has a wall with an exterior surface and an interior surface, and the wall has a thickness which is between 5.0% and 8.5% of an inner diameter of said tubular polymer plastic body to promote efficient heat transfer, between the coolant and said ice rink substrate, through the wall by providing less resistance to heat transfer; and a plurality of vanes are provided on the interior surface of the wall to reinforce the wall of the polymer plastic piping and prevent collapse thereof when embedding the polymer plastic piping within the substrate, said plurality of vanes on the interior surface have a radial height which is less than the radial thickness of the wall, said plurality of vanes on the interior surface are arranged in a helical pattern for promoting non-laminar flow of the coolant flowing through the tubular polymer plastic body and facilitating an intimate contact between the coolant and the interior surface of the tubular polymeric plastic body to maximize the heat transfer therebetween.

2. The ice rink installation according to claim 1, wherein the vanes are provided on the exterior surface of the wall to facilitate intimate contact with the substrate, and the vanes have a radial height which is less than the radial thickness of the wall.

3. The ice rink installation according to claim 1, wherein the tubular polymer plastic body has an inner diameter of 1 inch and the wall thickness is less than 0.085 inches.

4. The ice rink installation according to claim 1, wherein the tubular polymer plastic body has an inner diameter of 2 inches and the wall thickness is less than 0.170 inches.

5. The ice rink installation according to claim 1, wherein the vanes are provided on the exterior surface of the wall to facilitate intimate contact with the substrate.

6. The ice rink installation according to claim 1, wherein said wall thickness is between 5.0% and 6.5% of a maximum dimension of the inner diameter.

7. An ice rink installation having a plurality of interconnected rink boards defining a skating area of the ice rink installation, a first network of a plurality of separate lengths of polymer plastic piping being imbedded within a substrate of the ice rink installation at least beneath the skating area, said polymer plastic piping being coupled to a cooling source, via a cooling supply header and a cooling return header, to provide a coolant to said plurality of separate lengths of the polymer plastic piping and, in turn, said substrate to facilitate cooling of the ice rink installation;

wherein each separate length of the polymer plastic piping of said first network comprises:

a tubular polymer plastic body which has a wall with an exterior surface and an interior surface, and the wall has a thickness which is between 5.0% and 8.5% of an inner diameter of said tubular polymer plastic body to promote efficient heat transfer, between the coolant and ice rink substrate, through the wall by providing less resistance to heat transfer, and a plurality of vanes are provided on the interior surface of the wall to reinforce the wall of the polymer plastic piping and prevent collapse thereof when embedding the polymer plastic piping within the substrate, said plurality of vanes on the interior surface have a radial height which is less than the radial thickness of the wall, said plurality of vanes on the interior surface are arranged in a helical pattern for promoting non-laminar flow of the coolant flowing through the tubular polymer plastic body and facilitating an intimate contact between the coolant and the interior surface of the tubular polymeric plastic body to maximize the heat transfer therebetween.

8. The ice rink installation according to claim 7, wherein said ice rink installation further includes a heating source communicating, via a heating supply header and a heating return header, with a second network of a plurality of separate lengths of polymer plastic piping, and the second network of a plurality of separate lengths of polymer plastic piping is located below the first network of a plurality of separate lengths of polymer plastic piping.

9. The ice rink installation according to claim 8, wherein an upper most portion of the ice rink comprises:

at least one layer of wire mesh reinforcement which supports the first network of a plurality of separate lengths of polymer plastic piping;

at least one layer of concrete which completely covers both the wire mesh reinforcement and the first network of a plurality of separate lengths of polymer plastic piping;

at least one layer of compacted sand, located beneath the first network of a plurality of separate lengths of polymer plastic piping, supports the second network of polymer plastic piping; and at least one layer of polystyrene insulation is located between and separates the first and second networks from one another.

10. The ice rink installation according to claim 7 wherein the vanes are provided on the exterior surface of the wall and the vanes have a radial height which is less than the radial thickness of the wall.

11. The ice rink installation according to claim 7 wherein the vanes are provided on the exterior surface of the wall and the vanes have a radial height which is less than the radial thickness of the wall.

12. The ice rink installation according to claim 7, wherein the tubular polymer plastic body has an inner diameter of 1 inch and the thickness of the wall is less than 0.085 inches.

13. The ice rink installation according to claim 7, wherein the tubular polymer plastic body has an inner diameter of 2 inches and the thickness of the wall is less than 0.170 inches.

14. The ice rink installation according to claim 7, wherein the vanes are provided on the exterior surface of the wall.

15. The ice rink installation according to claim 7, wherein said wall thickness is between 5.0% and 6.5% of a dimension of the inner diameter.

16. The ice rink installation according to claim 1, wherein the helix pattern of the vanes forms an angle of about 5 degrees with a longitudinal axis of the tubular polymer plastic body.

17. The ice rink installation according to claim 7, wherein the helix pattern of the vanes forms an angle of about 5 degrees with a longitudinal axis of the tubular polymer plastic body.

18. An ice rink installation having a plurality of interconnected rink boards defining a skating area of the ice rink installation, a polymer plastic piping being imbedded within a substrate of the ice rink installation at least beneath the skating area, said polymer plastic piping being coupled to a cooling source to provide a coolant to said polymer plastic piping and, in turn, said substrate to facilitate cooling of the ice rink installation, wherein said polymer plastic piping comprises:

a tubular polymer plastic body which has a wall with an exterior surface and an interior surface, and the wall has a thickness which is between 5.0% and 8.5% of an inner diameter of said tubular polymer plastic body to promote efficient heat transfer through the wall; and a plurality of vanes are provided on and the interior surface of the wall and are arranged in a helical pattern to promote non-laminar flow through the polymer plastic piping and facilitate a more efficient heat transfer to the wall, the vanes reinforce the wall of the polymer plastic piping and prevent collapse thereof when embedding the polymer plastic piping within the substrate, the vanes have a radial height which is less than the radial thickness of the wall of the tubular polymer plastic body and the vanes promote non-laminar flow of a coolant through the tubular polymeric plastic body and facilitate an intimate contact between the coolant and the interior surface of the tubular polymeric plastic body to maximize the heat transfer therebetween; and the helix pattern of the vanes forms an angle of about 5 degrees with a longitudinal axis of the tubular polymer plastic body.

* * * * *